US006389620B1

(12) United States Patent
Hennessy

(10) Patent No.: US 6,389,620 B1
(45) **Date of Patent: *May 21, 2002**

(54) HAMMOCK HAVING RIDGE CORD

(75) Inventor: Thomas Hennessy, Galiano Island (CA)

(73) Assignee: The Hennessy Hammock Co., British Columbia (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/783,026

(22) Filed: Feb. 15, 2001

Related U.S. Application Data

(62) Division of application No. 09/262,448, filed on Mar. 4, 1999, now Pat. No. 6,185,763.

(51) Int. Cl.[7] ..... A45F 1/06

(52) U.S. Cl. ..... 5/120; 5/122; 5/121; 5/128

(58) Field of Search ..... 5/120, 121, 123, 5/98.1, 122, 128, 127, 130; 128/845; 135/98, 95, 133, 115

(56) References Cited

U.S. PATENT DOCUMENTS

| | | | | |
|---|---|---|---|---|
| 4,001,902 A | * | 1/1977 | Hall et al. | 5/121 |
| 4,071,917 A | * | 2/1978 | Mojica | 5/121 |
| 4,320,542 A | * | 3/1982 | Cohen | 5/121 |
| 4,686,720 A | | 8/1987 | Newell | |
| 5,038,428 A | | 8/1991 | Shur | |

* cited by examiner

*Primary Examiner*—Lynne H. Browne
*Assistant Examiner*—Fredrick Conley
(74) *Attorney, Agent, or Firm*—Shoemaker and Mattare

(57) ABSTRACT

A hammock includes a bed made of a rectangular piece of flexible, breathable material, whose ends are gathered together and secured to ropes which can be tied to respective trees. A ridge cord extends between the gathered ends, this cord being shorter than the bed, so that the bed sags somewhat no matter how much tension is applied to the ropes. An entrance slit extending about half the length of the hammock allows one to enter from below. The hammock has a lozenge shape when it is viewed from the top and may be covered by a lozenge-shaped canopy.

2 Claims, 8 Drawing Sheets

HAMMOCK HAVING RIDGE CORD

This application is a division of patent application Ser. No. 09/262,448, filed Mar. 4, 1999, now U.S. Pat. No. 6,185,763.

FIELD OF THE INVENTION

This invention relates to hammocks, particularly a hammock having a ridge cord providing a predictable sag in the hammock fabric.

BACKGROUND OF THE INVENTION

For camping and other recreational activities, different hammocks have been developed to provide shelter from insects, ground dwelling creatures and inclement weather. Being suspended above the ground, hammocks provide a more comfortable, dry, warm and clean surface than do tents.

Existing hammocks are entered by climbing over one side. This is difficult and sometimes dangerous, because the hammock is out of balance when a person enters it. The potential occupant pushes down one of the sides of the hammock, as low as possible, towards is its longitudinal axis of symmetry, to allow his access. As soon as the occupant sits down and his weight comes off his feet, the hammock swings back into its original position, tumbling the occupant backwards, and sometimes out of the hammock.

The entrance in an enclosed hammock, which is usually between the bed and insect net, is normally closed by a zipper. The zipper is tensioned and is easily damaged, if it is not fully opened before entry. If the zipper is damaged the hammock can no longer provide protection from insects. It is known also that a zipper in an enclosed hammock is its most vulnerable feature. In known hammock designs, where each suspending rope is attached to the hammock through a sewn sleeve at each end, all of the occupant's weight is transmitted to the stitches of the sewn sleeve. If one or several stitches are overloaded, they can fail and the entire stitching can unravel under the weight of the occupant. If the stitching is stronger than the fabric fibers, concentration of tension at one point may cause the material to fail, starting a tear which can open quickly and not stop until the occupant reaches the ground.

Hammock sag until now had to be adjusted by trial and error, by adjusting the suspending ropes while tying them to their anchors. If the suspending ropes at each end of the hammock are attached so that too much slack is present, the resulting sag will also be increased. In this situation, the occupant will be bent, and hence in an uncomfortable position. If the suspending ropes at each end of the hammock are pulled too tightly, the sag will be reduced too much. In this situation, trying to climb into the hammock is difficult and dangerous.

Hammocks of rectangular and trapezoidal shape are known. They allow a relatively restricted movement of occupant's arms and hands and they do not comply with the requirement that at the middle of the hammock, where the occupant is wider, the hammock must be wider as well. Attempts have been made to address and solve the above existing concerns. But it is apparent that up to the present time, there remains important shortcomings in hammocks.

U.S. Pat. No. 5,038,428 discloses a pillow and a slit added to an otherwise conventional hammock. The pillow is mounted atop the hammock, adjacent to the longitudinal edge mid-length of the hammock, so that the transverse axis of symmetry of hammock bisects the pillow. The incision has a predetermined longitudinal extent and is also positioned mid-length of the hammock and is bisected by the transverse axis of symmetry. The pillow and slit are on opposite sides of the longitudinal axis of symmetry of the hammock. A first individual standing in the incision may massage a second recumbent individual, whose head is supported by the pillow and whose feet may extend below the hammock or may rest atop the hammock on opposite sides of the first individual. The disclosed hammock is not designed for general use, but for a very specific one. The central location of the incision on one side of the longitudinal of symmetry of the hammock, does not allow a proper entry for the occupant.

U.S. Pat. No. 4,686,720 discloses a hammock comprising a lower support which is sewn to an upper cover. The lower support is cut in a trapezoidal shape and the wide part is intended to accommodate occupant's head and shoulder, the narrow lateral end being slightly gathered. A strip of fabric is sewn to the gathered fabric. The strip as well as the material of the lower fabric support, at the wide end, is folded over twice, sewn down and grommets are placed at intervals in the folded strip. A shortcoming of this hammock is that the trapezoidal form of the lower support does give the occupant a sense of space in the middle of the hammock and restricts movement of his arms and hands.

U.S. Pat. No. 4,001,902 discloses a combination comprising a hammock, an insulated sleeping bag and a tent. The hammock consists of a cloth of rectangular shape with a pocket, loop or similar device at each end, to accommodate a spreader bar of rigid material, such as wood or flight metal. Attached at two or more points to each spreader bar is a stringing assembly of approximately 4' to 5' in length which leads to a single point, such as a metal ring, which, in turn, is attached by a rope to a tree. The tent is held in position over the hammock and sleeping bag by a separate ridge cord attached to the same trees. As can be seen, the manner of attaching the combination bed and shelter, by using a pocket or loop at the end of the hammock, a spreader bar and a stringing assembly, is complicated.

SUMMARY OF THE INVENTION

The present invention is directed, broadly, to a hammock which includes a bed having an entrance slit, situated in the same vertical plane as its longitudinal axis of symmetry and located on one side of its center of symmetry.

The bed includes as well a self-closing feature for the entrance slit, located at midpoint of its short side, where the entrance slit begins.

This bed is formed from a rectangular sheet of material whose short ends are folded into a bundle. Each bundle of gathered folds is used to fasten the hammock by suspending ropes to anchors such as trees.

A ridge cord is provided for adjusting the sag of the hammock. The ridge cord extends in a vertical plane of symmetry, and goes through each opposite bundle of gathered folds, where it is connected to each suspending rope.

A side adjustment cord of the rectangular sheet has one end attached to the middle of each longitudinal side of the rectangular sheet, the other end being fastened to a fixed element, one side adjustment cord being provided at each side of the hammock.

The hammock has a lozenge shape as viewed from the top. This shape is formed when opposite side adjustment cords are outwardly stretched and opposite suspending ropes are tensioned. This bed is provided with a canopy cut in a lozenge form from a sheet of material. At each side of the canopy, where two concurrent edges of the lozenge form intersect the transversal axis of symmetry, an adjustably extending cord is attached.

In one aspect of this invention, the hammock has a bed which includes an entrance slit, situated in the same vertical plane as its longitudinal axis of symmetry and located on one side of its center of symmetry. The entrance slit extends from one of the short sides of the rectangular sheet of the flexible material from which it is made to a point short of its center of symmetry. The above disclosed bed of this hammock comprises as well a self- closing feature which is obtained by folding together several times, and then, holding in place, the edges of the entrance slit close to the corresponding short side of the substantially rectangular sheet of material, where the slit extends.

In another aspect of the invention, the hammock has a bed including a number of to gathered folds, situated at both of its ends and made of each short side of a substantially rectangular sheet which forms the bed. The bundle of gathered folds is used to fasten the hammock by suspending ropes to anchors. The bundle of gathered folds is made of each short side of the substantially regular sheet, which short side is folded several times parallel to the longitudinal axis of the rectangular sheet. The first fold is made towards the longitudinal axis and consists essentially of two layers, followed by a second fold of four layers, then eight layers and, finally, sixteen layers. Two resulting bundles of sixteen layers are folded together to form one bundle of gathered folds of thirty two layers of material, which are fastened together permanently, and in which one or more holes for suspending ropes are made. An accordion type of folding is an alternative solution. The folds of this accordion type of folding are fastened permanently and provided with one or more holes for attaching suspending ropes In another aspect of the invention, the hammock comprises a bed which includes for adjusting its sag, a ridge cord extending in a vertical plane, which plane includes the hammock's longitudinal axis of symmetry and going to the hammock ends, where is adapted to be attached individually to suspending ropes.

Another aspect of the invention is that the hammock has a ridge cord extending in a vertical plane, which plane includes the hammock's longitudinal axis of symmetry and, after passing through each of the hammock's ends, to which it is fastened, continues as a suspending rope.

This ridge cord has an adjustable length for altering its sag, according to individual comfort requirements. The adjustment is obtained by untying one end of the ridge cord and retying again to a shorter or longer length. Alternatively, an adjustment device may be used in combination with a part of the ridge cord which is intended as a slacked portion. This part is unwrapped or wrapped accordingly around the sag adjustment device, when the ridge cord is not under tension. This way, the extension of the slacked portion and consequently, the resulting number of subtracted or added wraps determines the workable length of the ridge cord, which effectively adjust the comfort level of the hammock.

In another aspect of this invention, the hammock comprises a bed including a side adjustment cord attached at one end to the middle of each longitudinal side of a substantially rectangular sheet from one which the bed is made, the other end being fastened to a fixed element. The adjustment cord is provided at each side of the hammock.

This hammock has a lozenge shape, viewed from the top, formed when opposite side adjustment cords are outwardly stretched and opposite suspending ropes of the hammock are tensioned. In another aspect of this invention, the hammock comprises a bed which includes a canopy made in a lozenge form from a sheet of substantially synthetic material, to which canopy an adjustably extending cord is attached with one end where two concurrent edges of the lozenge intersect the transverse axis of the sheet from which the canopy is made. The other end of the adjustably extendible cord is joined to a fixed feature. Each two concurrent edges of the lozenge form sheet, at their point of intersection with the longitudinal axis of the sheet, is attached to a suspending rope of the hammock.

BRIEF DESCRIPTION OF THE DRAWINGS

The concept and practical aspects of the invention are apparent from the purely exemplary, and therefore not restrictive, embodiments illustrated in the following examples, in which.

DETAILED DESCRIPTION OF THE PREFERRED EMBODIMENT

Figure 1:
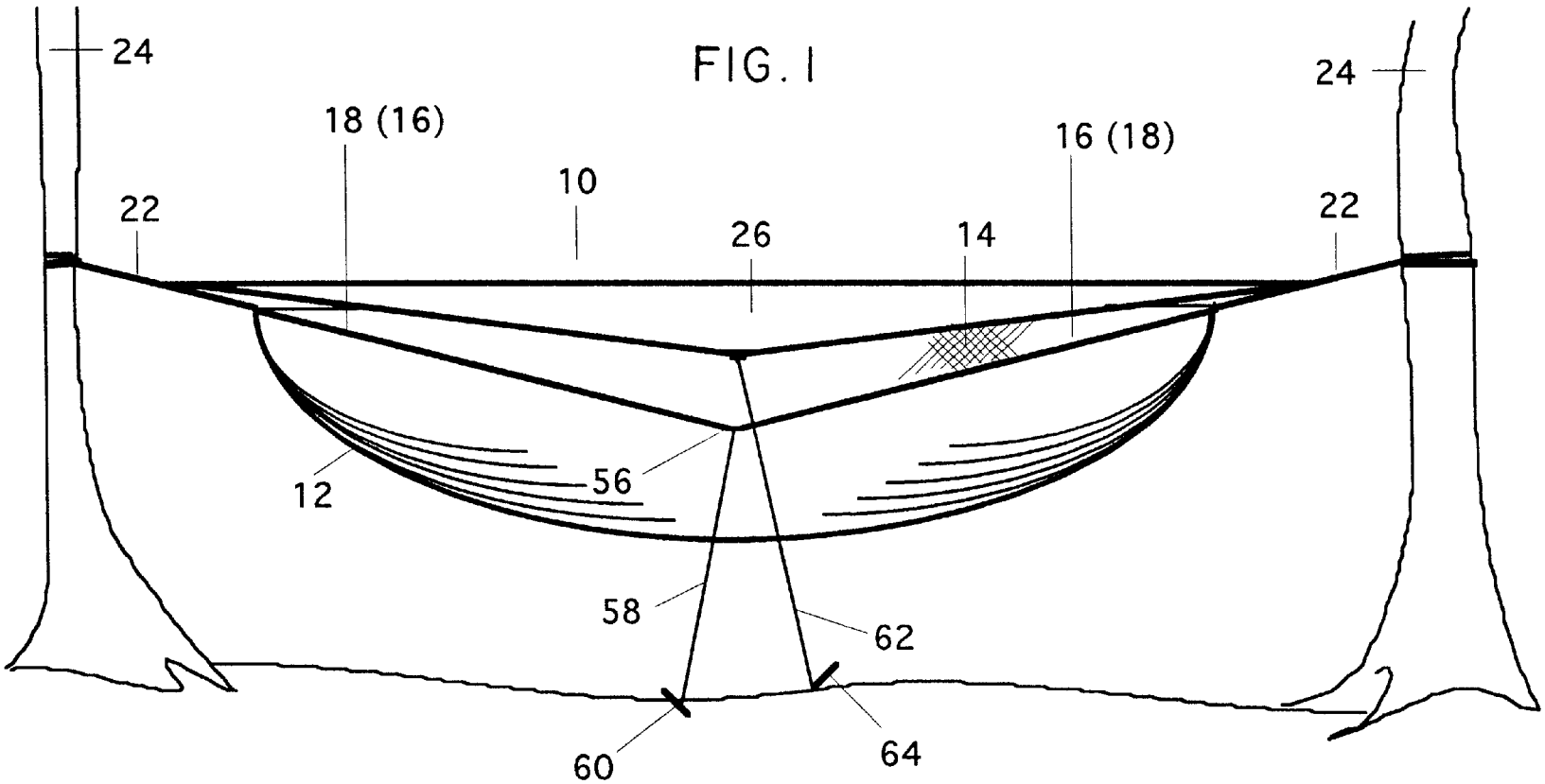
FIG. 1 illustrates schematically a side elevation of the hammock comprising the bed, insect net and canopy.
Figure 2:
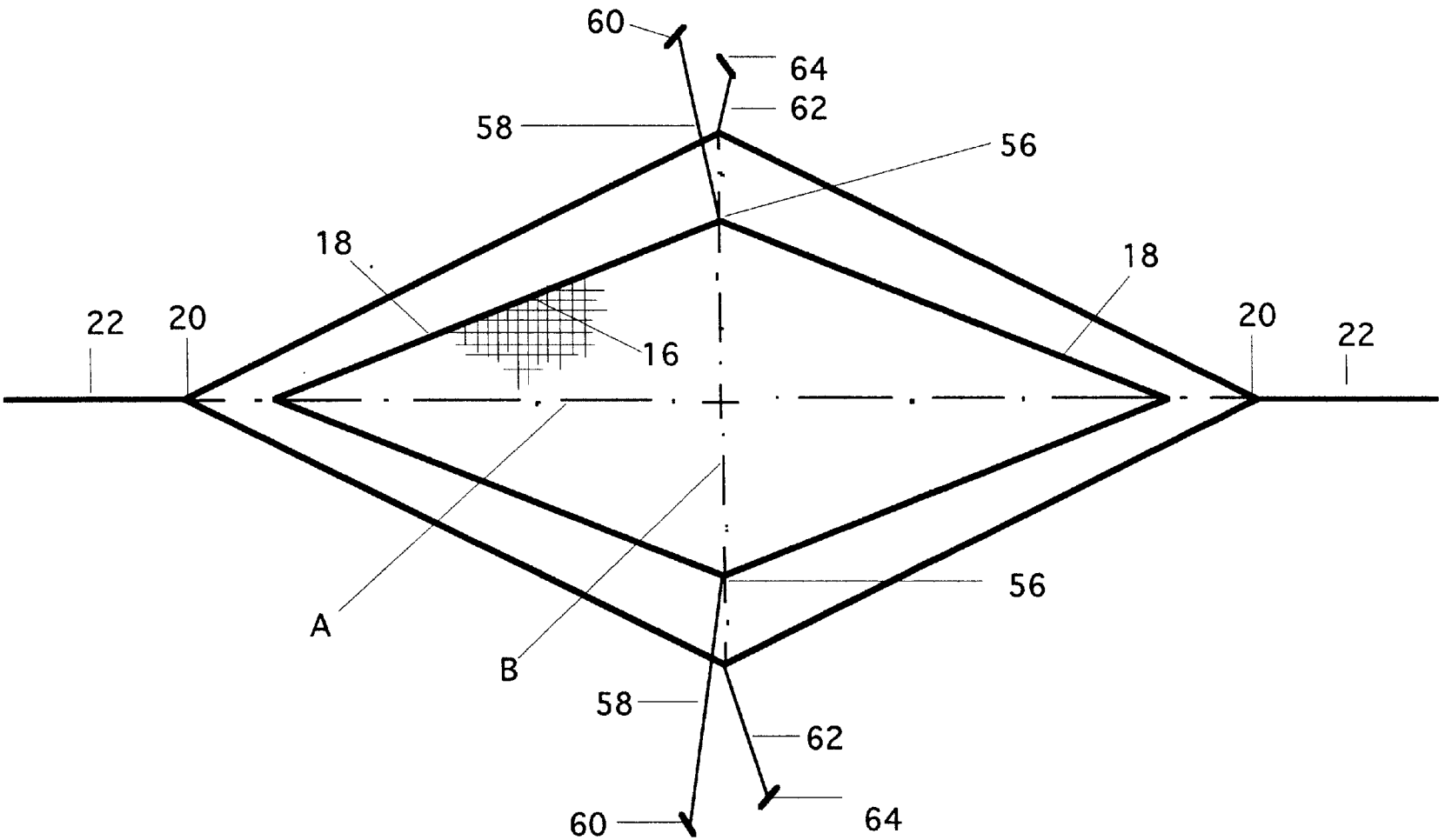
FIG. 2 illustrates schematically a top view which depicts the lozenge form of the bed, insect net and canopy.
Figure 3:
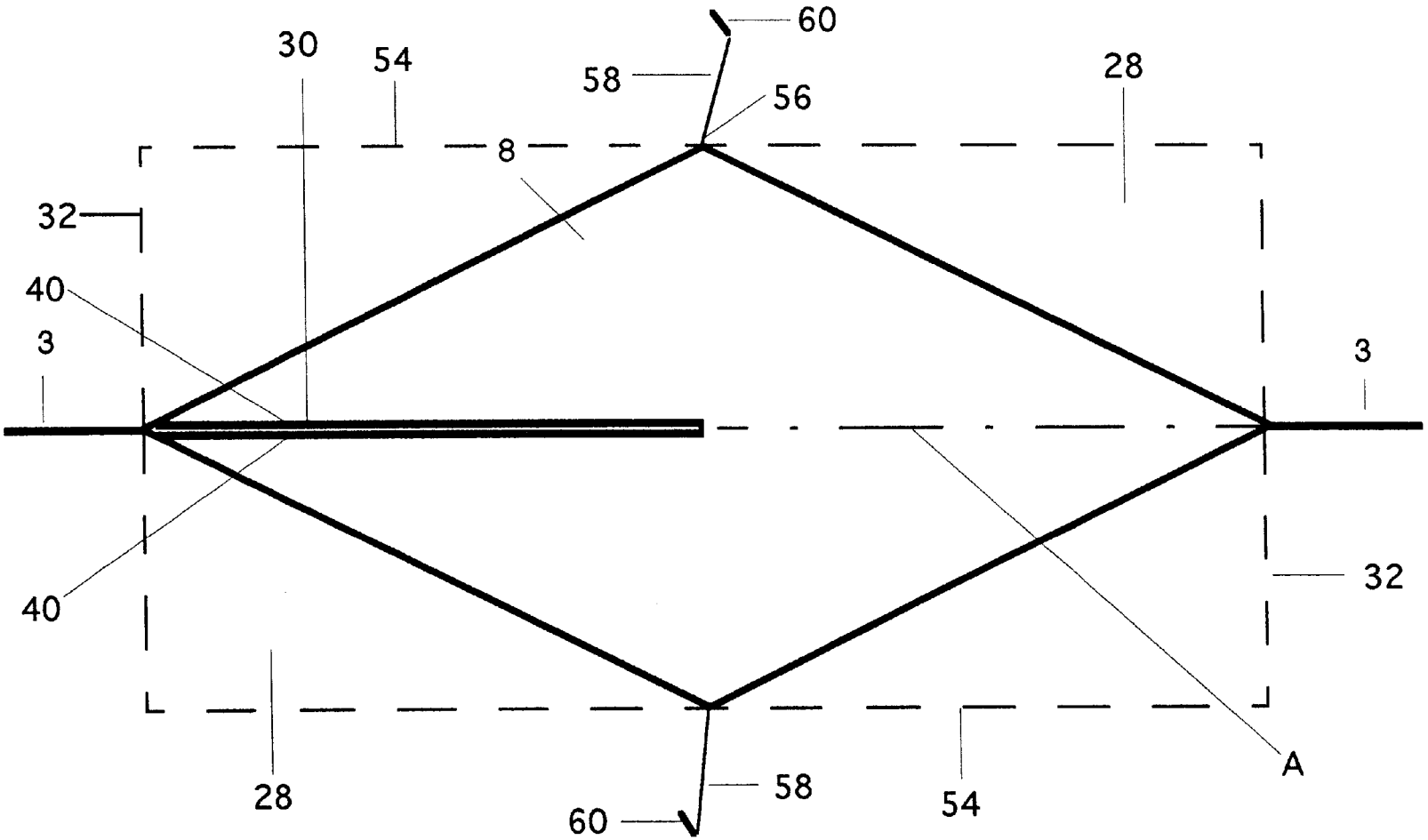
FIG. 3 illustrates schematically a plan view of the bed with its lozenge form and the initial rectangular sheet of material, from which the bed is made.
Figure 4:
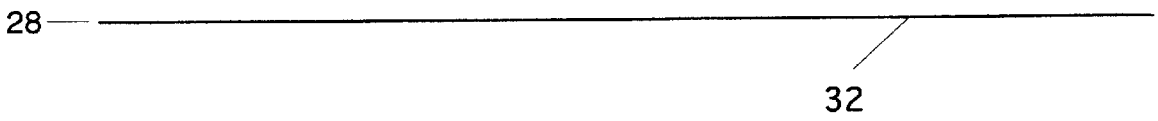
FIGS. 4 to 9 illustrate a sequence of end view schematic elevations depicting the operational steps for making the bundle of gathered folds.

As shown in FIG. 1, a hammock 10 comprises a bed 12, an insect net 14, which is located above bed 12 and is attached along its edge 16 to longitudinal sides 18 of bed 12. Each end 20 of the bed 12 is joined with a suspending rope 22 to a spaced anchor 24 such as a tree. A canopy 26 overhangs the insect net 14. Bed 12, dimensioned to provide accommodation for one or more persons, is made from a substantially rectangular sheet 23 (see FIG. 3) of flexible, breathable material. It must be of sufficient strength and resilience to withstand an appropriate load and repeated use under varying conditions. Nylon, polyester or a synthetic material with similar qualities is used.

Figure 5:
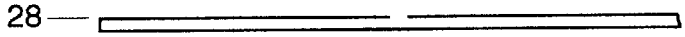
Figure 6:
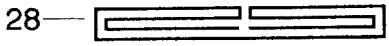
Figure 7:
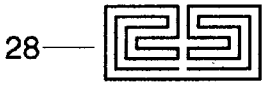
Figure 8:
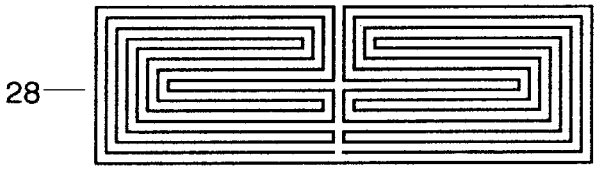
Figure 9:
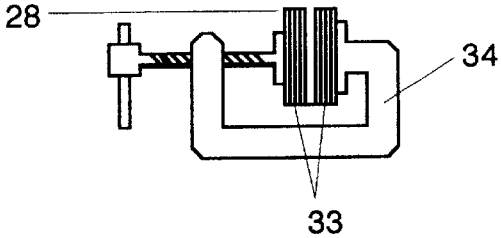
Figure 10:
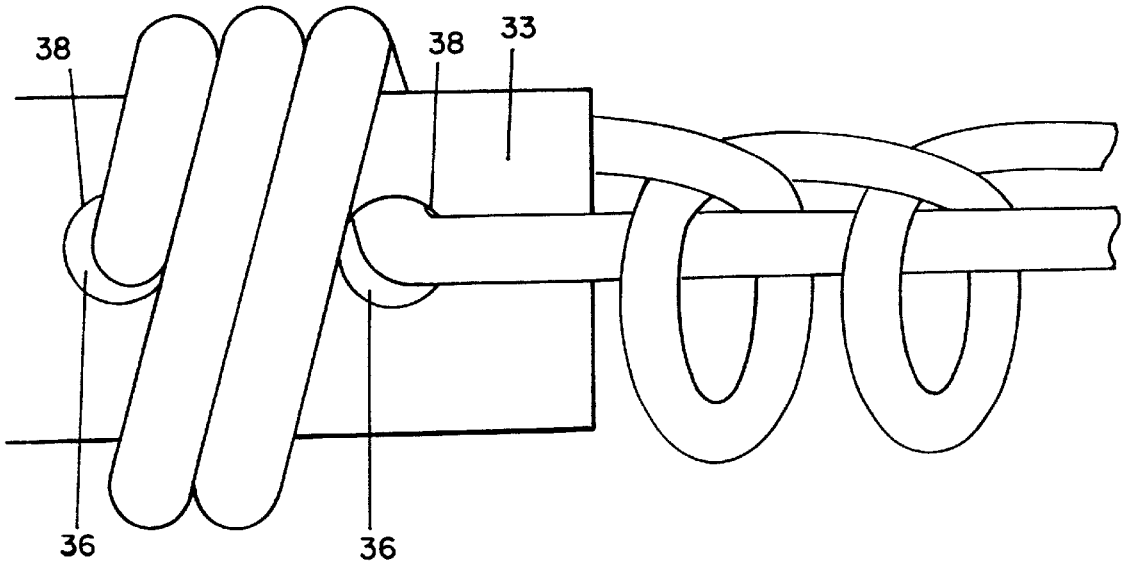
FIG. 10 illustrates a schematic side elevation of the bundle of gathered folds provided with holes.

An entrance slit 30, situated in the same vertical plane as bed 12's longitudinal axis of symmetry A, extends from one of the short sides 32 of a substantially rectangular sheet 28 to a point short of the center of symmetry of bed 12. The short side 32, opposite the entrance slit 30, of rectangular sheet 28 (see FIGS. 4 to 9) is folded several times parallel to the longitudinal axis A of sheet 28. The first fold of two layers of material is made towards the longitudinal axis of sheet 28 (see FIG. 5). Then, in the same manner, rectangular sheet 28 is folded in four layers (FIG. 6), then in eight layers (FIG. 7) and then, sixteen layers (FIG. 8). Finally, each bundle of sixteen layers is folded together to form one bundle of gathered folds 33 (thirty-two layers of material), which is held by a clamp 34 (FIG. 9) and fused by heat or bonded by an adhesive. Then, one or more holes 36 (FIG. 10) are cut or obtained by melting an aperture through the final bundle. A grommet 38 is provided for each hole 36.

Alternatively, an accordion-type of folding can be used. Attachment of each bundle of folds 33 to each suspending rope 22 is achieved by joining a suspending rope 22 directly to its respective bundle 33 with a knot. At the short side 32, corresponding to entrance slit 30, the process of folding is somewhat different, including an additional set of folds which provide a self-closing entrance slit 30. This self-closing is activated and maintained by the weight of the occupant. Here, the sequence of folding is the following: edges 40 of entrance slit 30 (FIG. 3), close to the corresponding short side 32, are folded together several times and held in place. Next, one follows the same operational steps (FIGS. 4 to 9), described for short side 32, opposite to entrance slit 30. This folding, as described, of edges 40, prior to the folding of short side 32, produces, under the weight of the occupant, the self-closing of entrance slit 30.

The operation of the entrance through slit 30 takes place as follows: The occupant either enters head first and turns around inside the hammock, or backs into the entrance slit until the back of his knees contact the low end of entrance slit 30. Then, the occupant sits down on bed 12, whose 28 becomes tensioned. As the occupant reclines against bed 12 and, as he lifts his legs off the ground, his entire weight is transmitted to bed 12. Lastly, the occupant lifts his legs through entrance slit 30, which closes, providing a bug-proof environment. The edges 40 of entrance slit 30 are folded together and held folded by the weight of the occupant.

Figure 11:
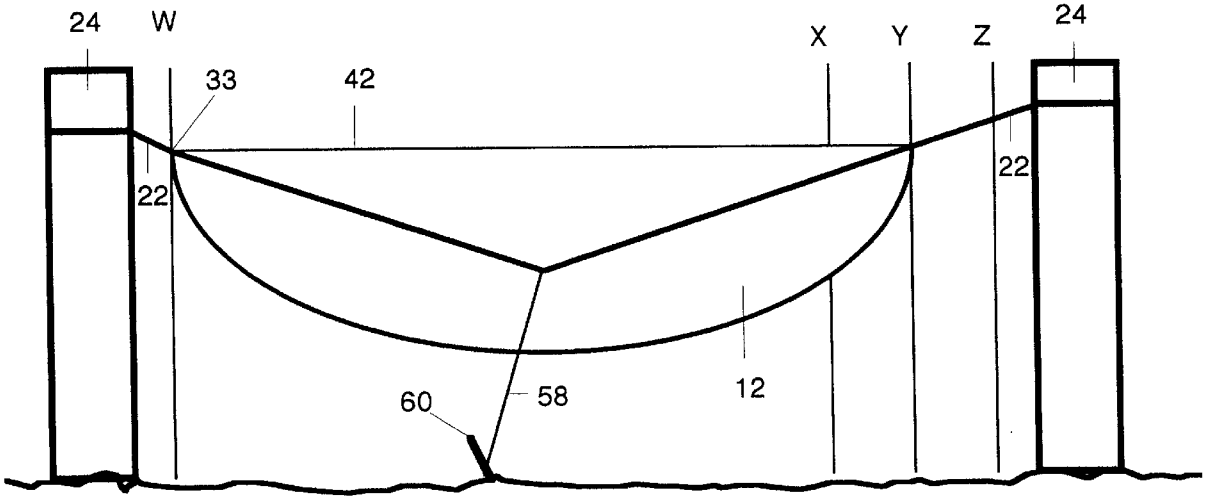
FIGS. 11 to 13 illustrates schematically side elevation of the bed using different adjustments of the ridge cord for modifying the sag of the bed.
Figure 12:
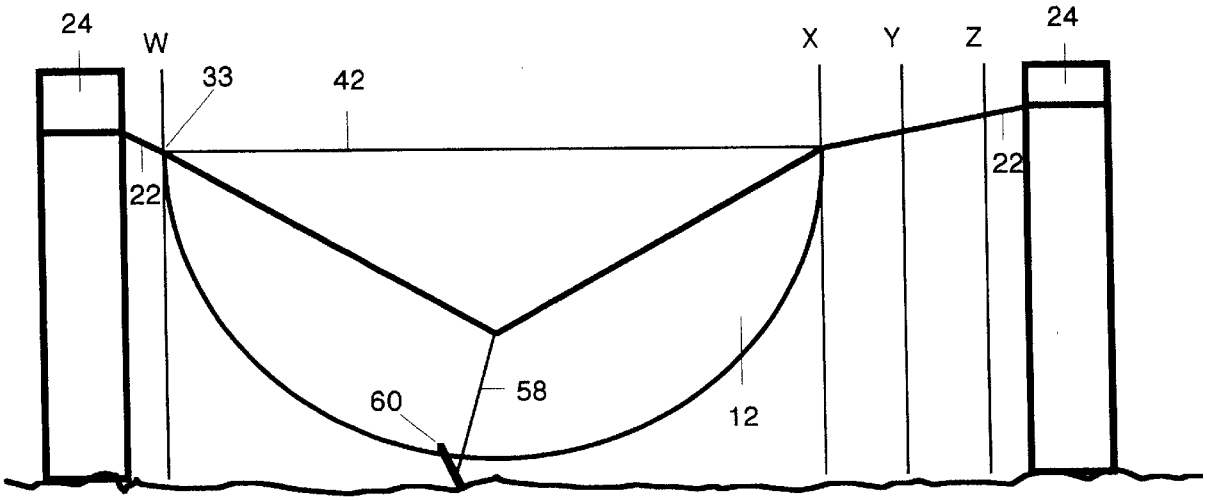
Figure 13:
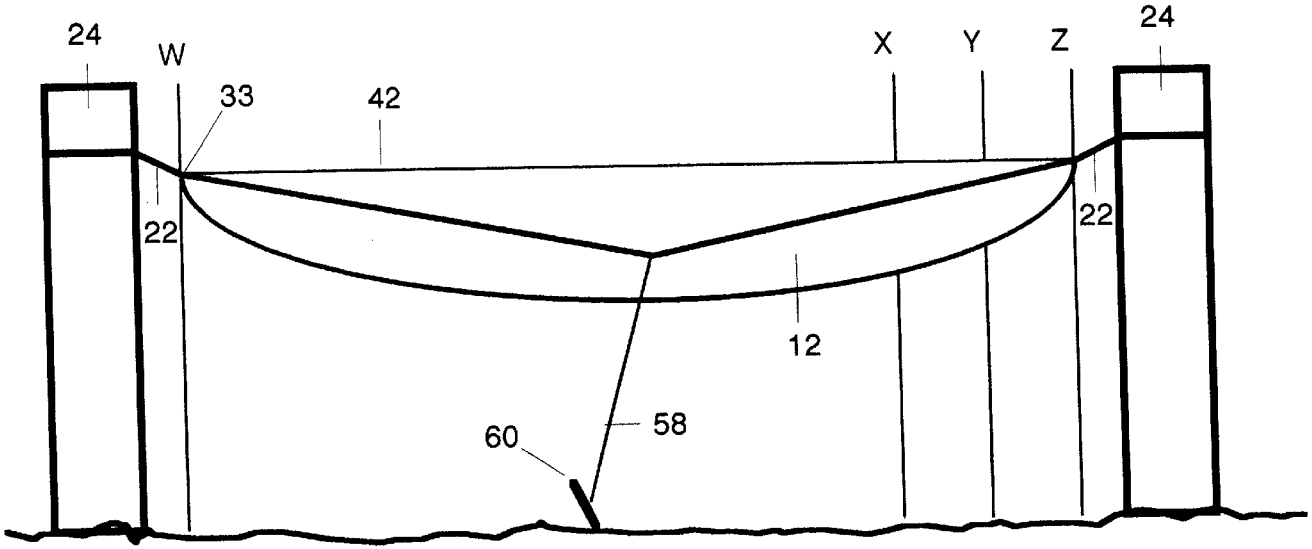
Figure 14:
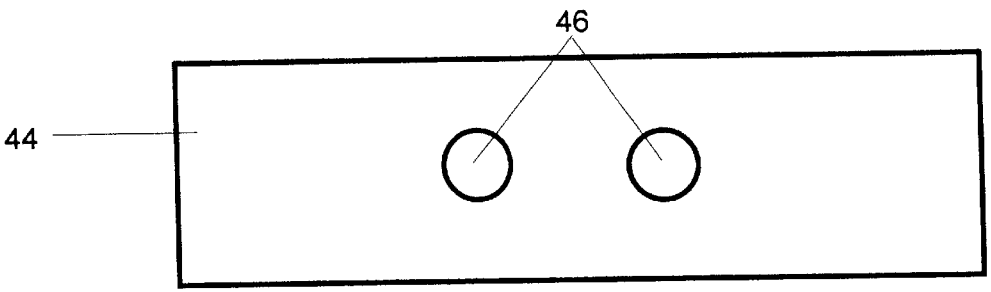
FIG. 14 illustrates schematically a side elevation of the sag adjustment device.
Figure 15:
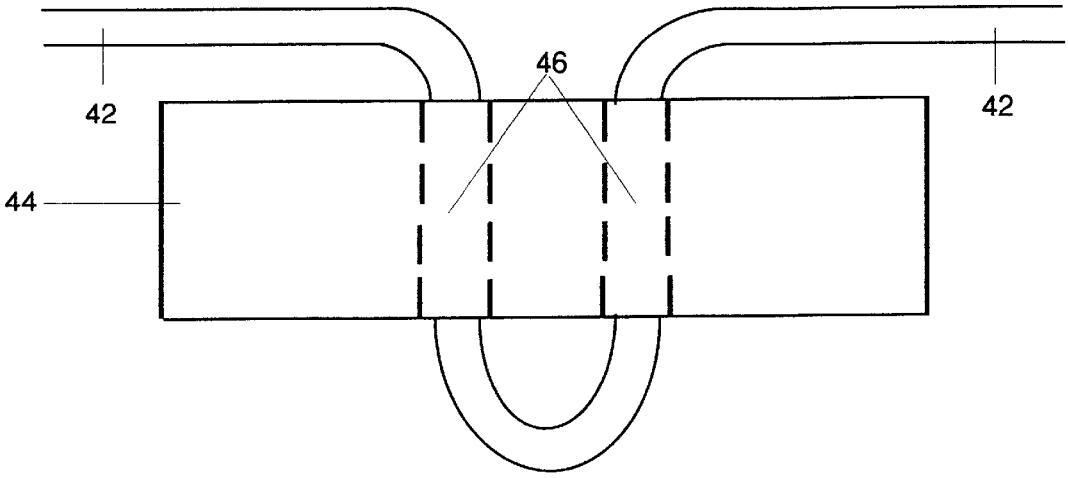
FIG. 15 illustrates schematically a side view elevation of the adjustment device with a slacked portion of the ridge cord before wrapping.

A ridge cord 42 (FIGS. 11 to 13) extends in a vertical plane which includes longitudinal axis A of bed 12 and goes through each opposite bundle of gathered folds 33 and is attached to each suspending rope 22 or, alternatively, the ridge cord 42 can be attached to at least one of holes 36. Alternatively, when no holes are used, the ridge cord 42 could be attached directly to each bundle of gathered folds. Preferably, the ridge cord 42 continues beyond its points of attachment at each opposite bundle of gathered folds 33 as suspending rope 22. In order to alter the sag of bed 12, according to individual comfort requirements, the workable length of ridge cord 42 (FIGS. 11 to 13) is adjustable by untying one end of it and retying again to a shorter or longer length. As can be seen in FIGS. 11 to 13, three examples illustrates a comparison of different adjustments. The distance between anchors 24 is constant. On the left side of all three figures (FIGS. 11 to 13), there is one vertical line which constitutes the line of reference. On the right side of all three figures are three vertical lines X, Y and Z.

The first example (FIG. 11) is a bed 12 with a ridge cord 42, whose workable length has been preset at the factory for the comfort requirements of an average user. Notice that ridge cord 42 terminates at line K, between Y and Z.

The second example (FIG. 12) is a of bed 12, where ridge cord 42 terminates at line Y. In this case, the workable length of ridge cord is shorter and the sag of bed 12 is increased.

The third example, (FIG. 13), is a bed 12 with a longer workable ridge cord 42. Ridge cord 42 now terminates at line Z. Thus, its length is increased but the sag of bed 12 is reduced.

Figure 17:
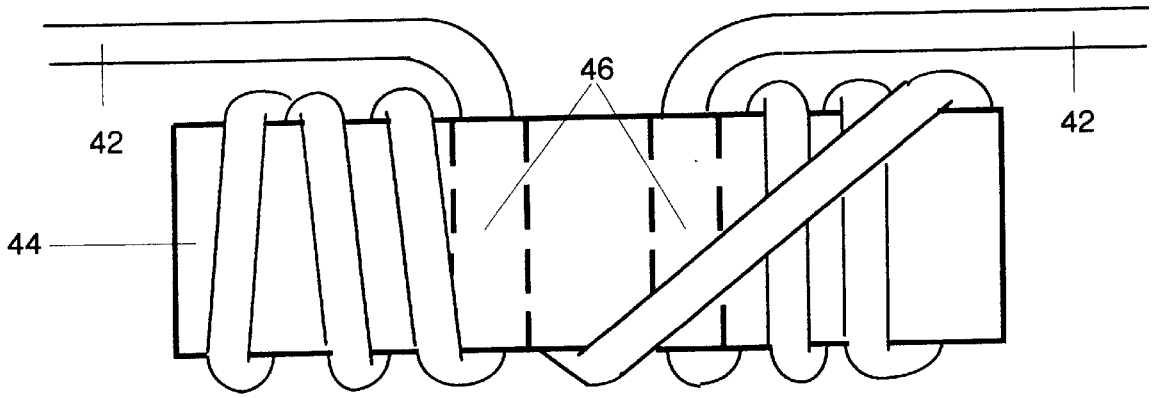
FIG. 17 illustrates schematically a side elevation view of the sag adjustment device with wraps added by the occupant to shorten the ridge cord, hence to increase the sag.
Figure 16:
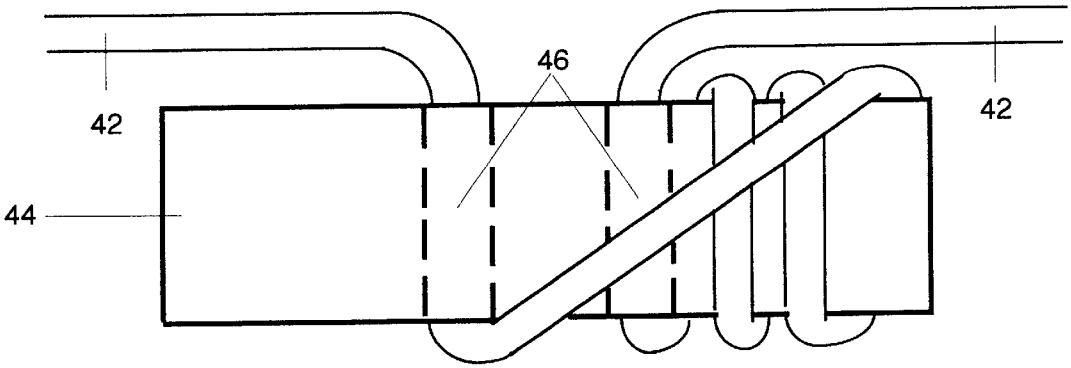
FIG. 16 illustrates schematically a side elevation view of the sag adjustment device wherein a portion of the ridge cord is pre-wrapped at the factory.

Alternatively, a sag adjustment device 44 (FIGS. 14 to 17) is provided. It has, in the presented embodiment, an elongated form with a circular cross section and two transverse holes 46. The ridge cord 42 passes successively through both transverse holes 46 and a stack portion 48 of ridge cord 42 is left between exit 50 of first hole 46 and entrance 532 of second transverse hole 46. The part of ridge cord 42, which constitutes slacked portion 48, is wrapped, when ridge cord 42 is not under tension, one or more times around either end of the sag adjustment device 44. The extension of slacked portion 48 and, consequently, the resulting number of added or subtracted wraps has a direct influence on the final workable length of ridge cord 42 and the corresponding amount of sag of bed 12. The adjustment, shown in FIG. 16, illustrates slacked portion 48, pre-wrapped at the factory to allow existing wraps to be unwrapped from or to allow additional wraps to be wrapped around sag adjustment device 44. The second adjustment, shown in FIG. 17, illustrates sag adjustment device 44 with additional wraps of ridge cord 42, wrapped onto device 44 by the occupant of hammock 10, to shorten ridge cord 42 and, hence, increase the sag of bed 12.

At approximately the middle of each longitudinal side 54 of the rectangular sheet 28, an attachment element 56 is secured. The attachment element 56 is normally provided with a grommet (not shown). A side adjustment cord 58 passes through the attachment element 56. The inner end of side adjustment cord 58 can be provided with means for length adjustment for example a cord lock of known type (not shown). The outer end of side adjustment cord 58 is attached to a fixed element 60.

The insect net 14 is formed from a sheet of substantially lozenge shape of synthetic mesh type material. Polyester or nylon are preferred. The edges 16 of the insect net 14 are attached to longitudinal edges 18 of bed 12. When the opposite side adjustment cords 58 are outwardly stretched and the suspending ropes 22 are tensioned, the shape of bed 12, viewed in plan, is a lozenge. The canopy 26 is cut in a lozenge form from a sheet of synthetic material such as nylon or polyester.

An adjustably extendible cord 62, for each side of canopy 26, is attached with one side where two concurrent edges of the lozenge intersect transverse axis B. The other end of the adjustably extendible cord 62 is joined to a fixed feature 64. Each two concurrent edges of the lozenge form the sheet of canopy 26 at their point of intersection with longitudinal axis A is attached to a suspending rope 22. Each length of side adjustment cord 62 can be independently adjusted. Either side of canopy 26 may be flipped over and secured to the other side, to provide coverage on one side only. From that position, both sides of canopy 26 may be rolled together and stored above ridge cord 42 and secured with a ring(not shown) slid from one end to the mid point of said canopy.

Since the invention is subject to modifications and variations, it is intended that the foregoing description and the accompanying drawings shall be interpreted as only illustrative of the invention defined by the following claims.

I claim:

1. A method of forming a bed from a piece of sheet material having symmetry about its longitudinal axis, said method comprising folding opposed lateral edges of said material upward and inward a first time toward said axis, forming a two-layer item having lateral folded edges, folding said lateral folded edges of said material upward and inward a second time toward said axis, forming a four-layer item having lateral twice-folded edges, folding said lateral folded edges of said material upward and inward a third time toward said axis, forming an eight-layer item having lateral thrice-folded edges, folding said lateral folded edges of said material upward and inward a fourth time toward said axis, forming a sixteen-layer item having lateral four times-folded edges, folding said material in half along said axis, forming a thirty-two layer bundle of folds, permanently securing said folds together, and forming holes in said secured folds through which a ridge cord can be inserted.

2. A method of hanging a hammock having a bed made of a piece of sheet material, said method comprising steps of gathering said sheet material at opposite ends, providing a ridge cord for suspending the bed from said opposite ends, securing said cord to said opposite ends in such a way that the effective length of the cord is shorter than the length of the sheet material, whereby the bed sags even when the cord is taut, suspending the hammock between a pair of trees by tying each of said gathered opposite ends to a respective one of said trees, and then adjusting the effective length of the ridge cord, whereby one can adjust the sag of the bed for maximum comfort, by (a) providing an elongate element having two spaced holes, (b) passing the cord through both said holes forming a bight between said holes, and (c) wrapping a said bight at least around one end of said element to shorten the cord.

* * * * *